US007009151B2

(12) United States Patent
Lee

(10) Patent No.: US 7,009,151 B2
(45) Date of Patent: Mar. 7, 2006

(54) MOUNTING STRUCTURE OF HEATING ELEMENT

(75) Inventor: Tae Hoon Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/989,501

(22) Filed: Nov. 17, 2004

(65) Prior Publication Data

US 2006/0027561 A1 Feb. 9, 2006

(30) Foreign Application Priority Data

Aug. 9, 2004 (KR) ..... 10-2004-0062364
Aug. 9, 2004 (KR) ..... 10-2004-0062365

(51) Int. Cl.
*H05B 3/68* (2006.01)

(52) U.S. Cl. ..... 219/460.1; 219/451.1

(58) Field of Classification Search ..... 219/451.1, 219/452.11, 452.12, 454.12, 460.1, 461.1; 126/393, 90 A, 92 AC, 92 A, 92 B
See application file for complete search history.

(56) References Cited

U.S. PATENT DOCUMENTS 3,987,275 A * 10/1976 Hurko ..... 219/451.1
4,032,750 A * 6/1977 Hurko ..... 219/455.12
4,150,280 A * 4/1979 Hurko ..... 219/455.12
4,788,414 A * 11/1988 Schreder ..... 219/451.1

* cited by examiner

*Primary Examiner*—Sang Paik
(74) *Attorney, Agent, or Firm*—Birch, Stewart, Kolasch & Birch, LLP

(57) ABSTRACT

A mounting structure of a heating element is provided. The structure includes: a heater supporting bracket that is interposed between a radiant heating element and a supporting panel and whose one side is fixed by a screw and whose other side is elastically supported so as to elastically support the radiant heating element.

26 Claims, 5 Drawing Sheets

MOUNTING STRUCTURE OF HEATING ELEMENT

BACKGROUND OF THE INVENTION

1. Field of the Invention

The present invention relates to a mounting structure of a heating element, and more particularly, to a mounting structure of a heating element, provided to a lower portion of the heating element so as to stably support the heating element formed in an inside of a cooktop. More specifically, the present invention relates to a mounting structure of a heating element, capable of preventing disorder of a radiant heating element itself and destruction of the cooktop by elastically supporting a rear surface of the radiant heating element so as to firmly support the radiant heating element against unexpected impulse from the outside.

2. Description of the Related Art

Generally, a cooktop is an element having a hot plate made of ceramic or glass in its upper surface and providing a predetermined heating source to a lower portion of the hot plate so as to heat a cookware put on an upper surface of the hot plate by heating the hot plate. The cooktop is well known by lots of references.

An induction heating element and a radiant heating element may be provided inside the cooktop. The induction heating element performs a heating by a high frequency heating source heated by an induction method, and the radiant heating element performs a heating by high heat radiated from a heating coil. In addition, the induction heating element and the radiant heating element have their lower portions supported by a predetermined spring members, which elastically operate in order to increase contact degree with respect to the hot plate as well as perform a predetermined buffering operation against an external impulse. The spring member is varied in its shape depending on shapes and kinds of the radiant heating element and the induction heating element. The present invention mainly focuses on a supporting structure of the radiant heating member.

As described above, the spring member of the radiant heating element according to the related art includes an elastic member for performing a buffering function against an external impulse. Further, the elastic member has one end fixed to the radiant heating element and the other end fixed to a predetermined position of a cooktop, thereby performing operation of its own so that the radiant heating element may come into more close contact with the cooktop. Example of the spring member is disclosed in the U.S. Pat. No. 5,841,109 entitled "Glass supported heating elements for radiant cooktop ranges". Referring to the patent, a role of the radiant heating element can be fully understood.

Since the general mounting structure of the heating element as suggested by the reference has limitation in elastic force of the spring member, if the spring member is deteriorated, the rear surface of the radiant heating element cannot be stably supported. Particularly, such a problem is more serious for the radiant heating element where high heat is generated.

Also, a manufacturing cost is increased due to the complexity of the mounting structure of the radiant heating element and the manufacturing process thereof.

Further, if the spring member is detached due to an unexpected impulse from the outside, the cooktop does not normally operate and should be provided with service from the manufacturing company.

SUMMARY OF THE INVENTION

Accordingly, the present invention is directed to a mounting structure of a heating element that substantially obviates one or more problems due to limitations and disadvantages of the related art.

An object of the present invention is to provide a mounting structure of a heating element, capable of reliability of a cooktop by stably supporting a spring member even if an external impulse is applied.

Another object of the present invention is to provide a mounting structure of a heating element, capable of supporting a position of the heating element in a stable and reliable manner even if the product is used for a long time.

To achieve these objects and other advantages and in accordance with the purpose of the invention, as embodied and broadly described herein, a mounting structure of a radiant heating element includes: a radiant heating element; a hot plate to which heat of the radiant heating element is transferred; a cooktop frame by which the hot plate is supported; a supporting panel formed at a lower portion spaced from the radiant heating element; a heater supporting bracket prepared between the radiant heating element and the supporting panel, for having the radiant heating element stick to the hot plate; and a panel supporting bracket prepared between the supporting panel and the cooktop frame, for having the supporting panel hung.

In another aspect of the present invention, a mounting structure of a radiant heating element includes: a radiant heating element; a hot plate to which heat of the radiant heating element is transferred; a cooktop frame by which an outer periphery of the hot plate is supported; a supporting panel formed at a lower portion spaced from the radiant heating element; and a heater supporting bracket having a fixing part aligned with the radiant heating element and formed at one end, for being fixed by a predetermined fastening member, and an elastic fixing protuberance elastically transformed at and inserted into a predetermined position of the supporting panel.

In further another aspect of the present invention, a mounting structure of a radiant heating element includes: a radiant heating element; a hot plate to which heat of the radiant heating element is transferred; a supporting panel formed at a lower portion spaced from the radiant heating element; and a heater supporting bracket which forms an inverted triangle and whose one upper corner is fixed at the radiant heating element and whose lower corner is inserted into and fixed at the supporting panel by a predetermined protuberance and whose other upper corner supports a lower portion of the radiant heating member.

In still further another aspect of the present invention, a mounting structure of a radiant heating element includes: a hot plate to which heat of the radiant heating element is transferred; a cooktop frame by which an outer periphery of the hot plate is supported; a supporting panel formed, as a separate member, at a rear surface of the radiant heating element; and a heater supporting bracket such that either of its radiant heating member side or its supporting panel side is fixed by a predetermined fastening member and the other side is elastically transformed and inserted to be variably supported.

According to the suggested present invention, the heating element can have its lower portion stably supported and closeness with the hot plate maintained almost permanently. Further, even if unexpected external impulse is applied, plastic deformation is not generated at a mounting structure of the heating element but only elastic deformation is generated to some extent and then the mounting structure can be restored, thus a position of the heating element can be stably maintained.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

First Embodiment

Figure 1:
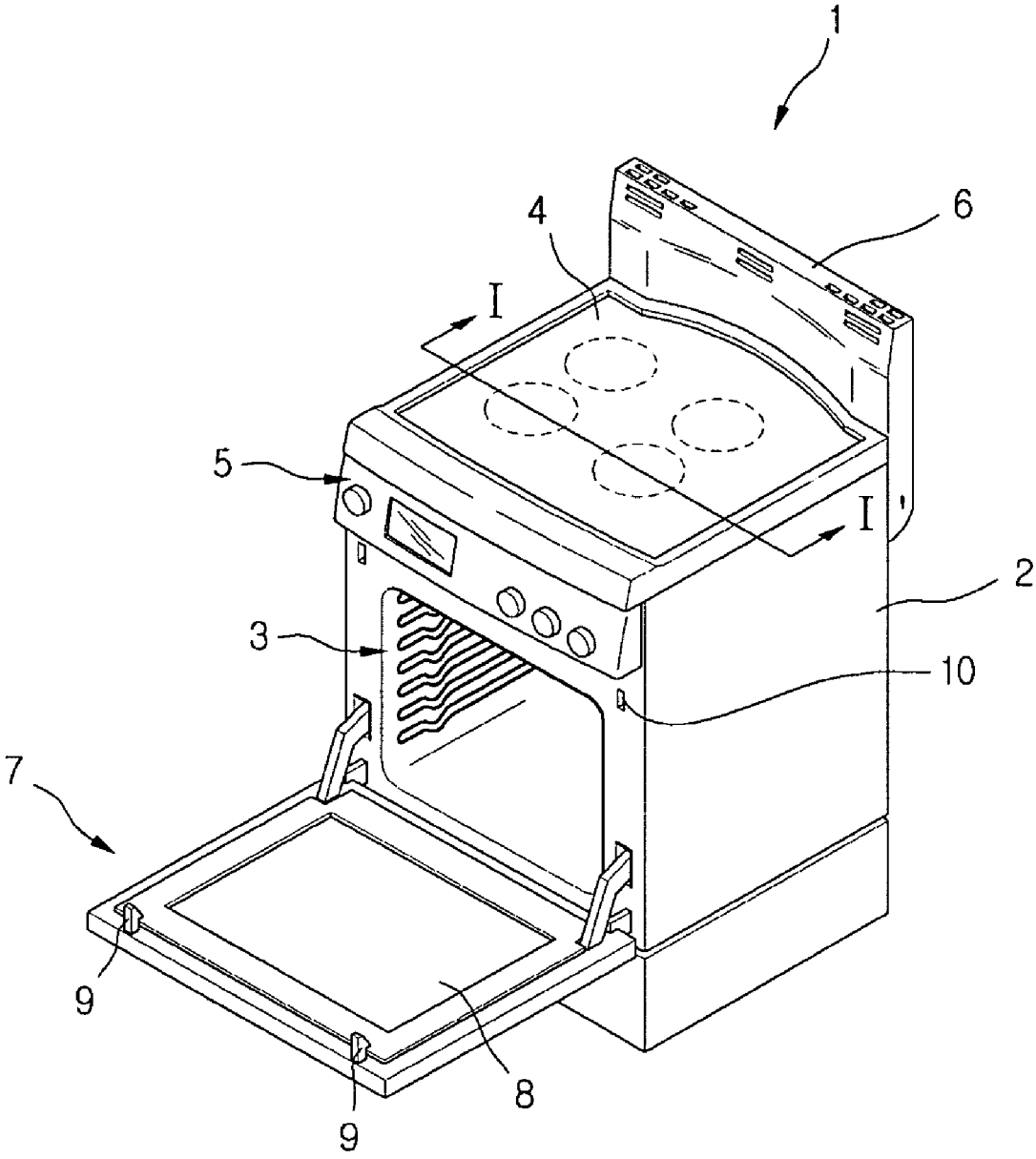
FIG. 1 is a perspective view of an oven to which the present invention is applied.

FIG. 1 is a perspective view of an oven to which the present invention is applied.

Referring to FIG. 1, an oven 1 is provided as one cookware to which the present invention is applied. The oven 1 includes: a main machine 2 having a cavity 3 of high temperature in its inside; a cooktop 4 formed on an upper side of the main machine 2; a back guard 6 formed on a rear side of the main machine 2, for exhausting steam occurring while cooking foods contained in an inside of the cavity 3; an operation part 5 with which an operation state of the oven 2 is controlled by a user; and a door 7 for selectively opening or closing a front side of the cavity 3.

Also, the oven 1 includes a door switch 9 and a switch receiving member 10 at one side of the door 7. The door switch 9 is extended from the door 7 and a switch receiving member 10 is formed on a predetermined position of the main machine 2 such that the door switch 9 is inserted thereinto and the door 7 is fixed in itself. Further, a window 8 through which a cooking state of foods contained in the inside of the cavity 3 can be observed with a natural eye is provided to a central portion of the door 7.

In FIG. 1, an integral oven having a cavity 3 and a cooktop 4 is provided as one example. Main subject of the present invention is focused on an inner structure of the cooktop 4, and the cooktop structure of the present invention can be readily applied to other type cookware, which will fall within the spirit of the present invention.

Figure 2:
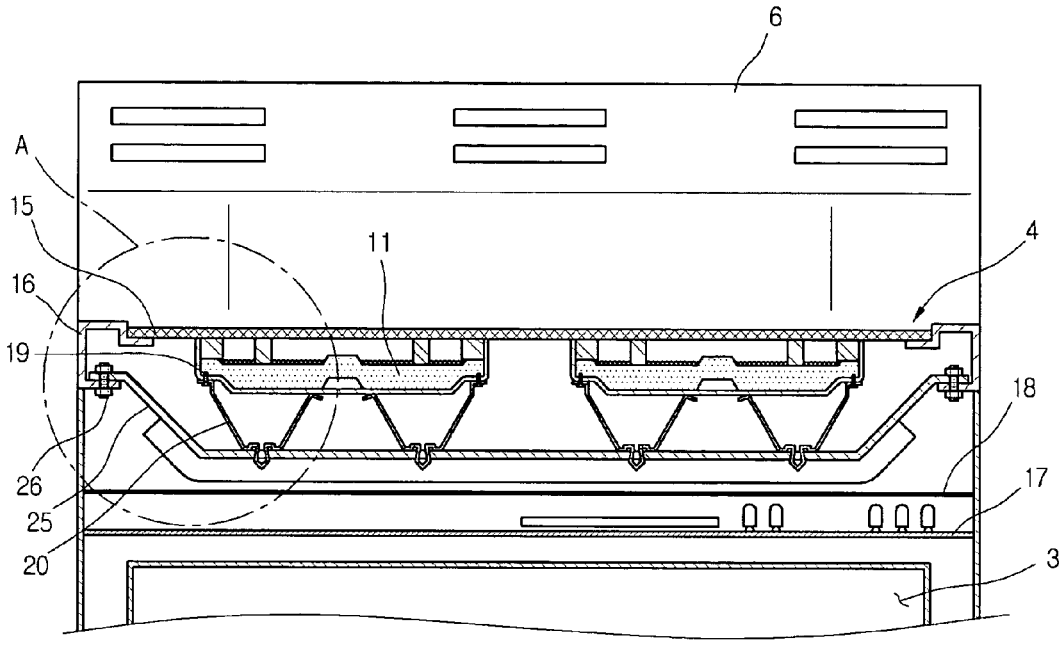
FIG. 2 is a perspective view taken along line I–I' of FIG. 1.

FIG. 2 is a perspective view taken along line I–I' of FIG. 1. An inner structure of the cooktop is illustrated in detail in FIG. 2. The present invention will be described in more detail with reference to the inner structure of the cooktop.

Referring to FIG. 2, the oven 11 includes a cooktop 4 on which a cookware such as a pot is put and a cavity 3 formed on a lower portion of the cooktop to receive foods. In addition, a shield 18 for partitioning the cooktop 4 and the cavity 3 are provided. Further, an electric equipment unit 17 for controlling heat and a wind tunnel of the oven 1 is provided to an upper portion of the cavity 3. The shield 18 is intended for shielding the cooktop 4 and the cavity 3 structurally and/or thermally. Here, the back guard 6 and the cavity 3 may communicate each other so that a flowing path of discharging a damp air in the inside of the cavity 3 to the back guard 6 may be formed across the shield 18.

More specifically, the cooktop 4 includes: a radiant heating element 11 where high heat is generated; a hot plate 15 made of ceramic or glass and placed on an upper surface of the radiant heating element 11 and on which a cookware such as a pot is put; a cooktop frame 16 for supporting the hot plate 15 and the radiant heating element 11; a supporting panel 25 formed across a lower portion of the cooktop frame 16 and whose both ends are supported by the cooktop frame 16; and a heater supporting bracket 20 for connecting the supporting panel 25 with the radiant heating element 11 so that a rear surface of the radiant heating element 11 is elastically supported. The heater supporting bracket 20 has an upper surface of the radiant heating element 11 closely touched to the hot plate 15 by having the radiant heating element 11 elastically supported in an upward direction.

The heater supporting bracket 20 is approximately a triangle shape, one corner of which is inserted into and fixed to the supporting panel 25 and other corner of which is fixed at the radiant heating element 11 by a second fastening member 19 and another corner of which supports a rear surface of the radiant heating element 11. The heater supporting bracket 20 may be formed by bending a ribbon-type steel plate of a thin thickness and the same width. At least one corner is inserted into and fixed to the supporting panel 25 and the other two corners supports the radiant heating element 11 upward. Thus, even if the oven 11 and/or the radiant heating element 11 fluctuate up and down to some extent, the hot plate 15 and the radiant heating element 11 can be precisely touched each other thanks to elastic force of the heater supporting bracket 20. Thus, closeness of the two elements can be maintained. Further, since the hot plate 15 is closely touched to the radiant heating element 11, heat of the radiant heating element 11 can be efficiently transferred to the hot plate 15 and, also, the hot plate 15 and the radiant heating element 11 are not destroyed due to an external impulse.

Further, both ends of the supporting panel 25 are joined to the cooktop frame 16 by the first fastening member 26 with at least part of the supporting panel 25 aligned with the cooktop frame 16.

Figure 3:
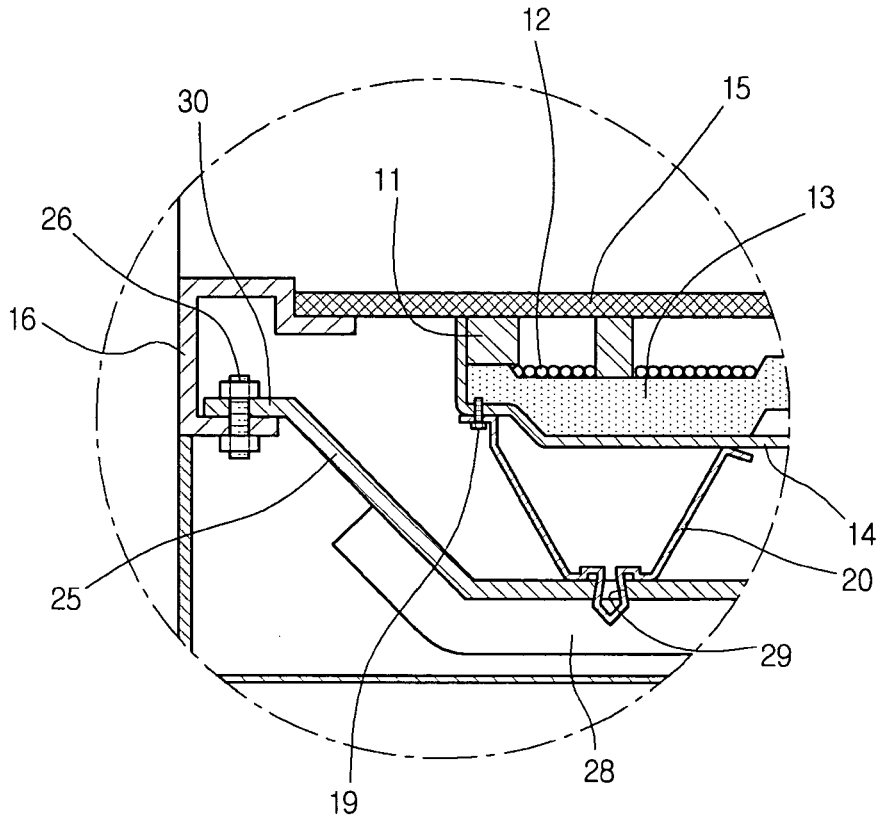
FIG. 3 is an enlarged view of a part "A" of FIG. 2.

FIG. 3 is an enlarged view of a part "A" of FIG. 2. A mounting structure of the heating element will be described in detail with reference to FIG. 3.

The radiant heating element 11 includes: a hot coil 12 where high heat is generated due to a current flowing through its inside; a heat insulating material 13 for insulating the hot coil to transfer heat upward only; and a base 14 for supporting a lower appearance of the heat insulating material 13 and forming an outer casing of the heat insulating material 13. Of course, the hot plate 15 is placed on the upper surface of the radiant heating element 11 and a cookware such as a pot is put on an upper surface of the hot plate 15 so that cooking of foods may be performed.

Further, an outer periphery of the hot plate 15 is supported by the cooktop frame 16, such that a position of the hot plate 15 can be supported. That is, the hot plate 15 is settled down on a groove portion of an upper part of the cooktop frame 16, so that a formation position of the hot plate 15 can be supported.

Further, the supporting panel 25 is provided to a lower portion spaced from the radiant heating element 11 and a fixing part 30 overlapped over a lower part of the cooktop frame 16 is provided to both ends of the supporting panel 25. A first fastening member 26 exemplified as a screw is inserted into a predetermined hole formed on the fixing part 30, so that the supporting panel 25 can be firmly fixed to the cooktop frame 16.

Further, the heater supporting bracket 20 is provided between the radiant heating element 11 and the supporting panel 25, such that a restoring force for pushing the radiant heating element 11 upward is applied constantly. Here, the radiant heating element 11 and at least one end of the heater supporting bracket 20 are fixed by a second fastening member 19, so that the radiant heating element 11 can be firmly fixed. It is preferable to firmly support a position of the radiant heating element 11 by forming the heater supporting bracket 20 on at least two or more locations in a lower portion of the single radiant heating element 11.

Figure 4:
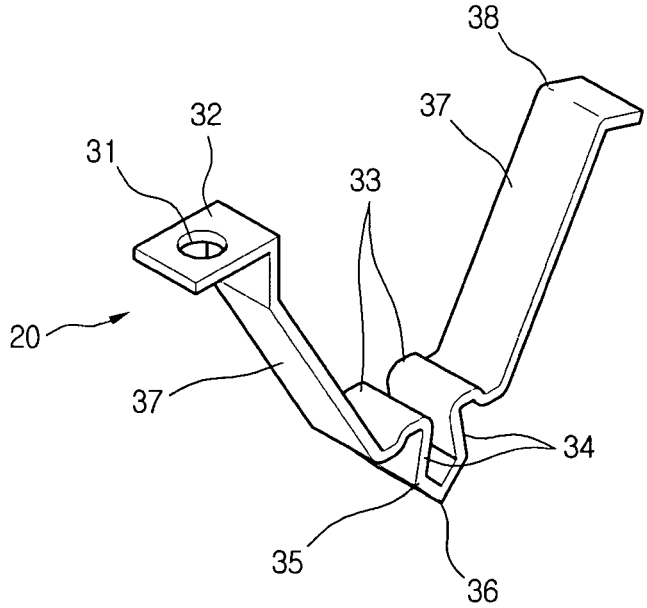
FIG. 4 is a perspective view of a heater supporting bracket.
Figure 5:
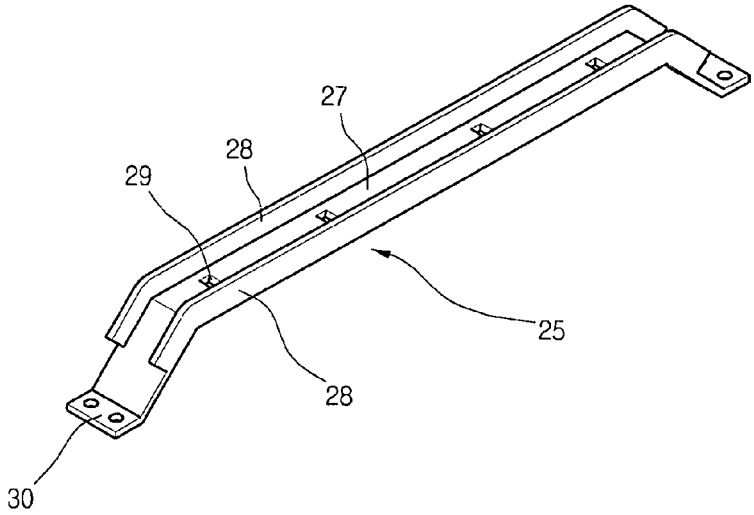
FIG. 5 is a perspective view of a supporting panel.

The heater supporting bracket 20 and the supporting panel 25 will now be described in more detail. FIG. 4 is a perspective view of the heater supporting bracket and FIG. 5 is a perspective view of the supporting panel.

Referring to FIG. 4, the heater supporting bracket 20 is a frame whose cross-section is approximately an inverted triangle shape. The heater supporting bracket 20 includes: a fixing part 32 horizontally extended having a fixing hole 31 on it; an elastic supporting part 37 bent and extended a predetermined angle to a lower direction from the fixing part 32; an elevation part 33 horizontally extended from a lower end of the elastic supporting part 37 and then elevated upward a predetermined height; a contraction part 34 extended downward from the elevation part 33 and whose width gets narrow toward as it goes upward; a hooking part 35 formed most widely in its width at a lowermost portion of the contraction part 34 and at which a predetermined hole is hooked; and an insertion terminal 36 further extended downward from the hooking part 35 and whose lower end forms a cusp.

Further, a supporting terminal 38 touched to a rear surface of the radiant heating element 11, for supporting the radiant heating element 11 is provided to an opposite side of the fixing part 32. An end of the supporting terminal 38 is bent downward so that the radiant heating element 11 may be supported by a predetermined line contact.

More specifically, the second fastening member 19 is inserted into the fixing hole 31 so that the heater supporting bracket 20 may be fixed and joined to the radiant heating element 11 on the whole. The elastic supporting part 37 is a portion for providing a margin within a range of which the heater supporting bracket 20 can be elastically transformed between the radiant heating element 11 and the supporting panel 25. It is easily estimated that a distance between the radiant heating element 11 and the supporting panel 25 is lengthened or shortened by an operation that the elastic supporting part 37 is folded or unfolded. Thanks to the transformation of the elastic supporting part 37, a position of the radiant heating element 11 can be firmly supported even if an impulse is applied from the outside.

Further, the elevation part 33 is a portion for use in reliably performing an elastic transformation of the elastic supporting part 37. In addition, a vertical length of the contraction part 34 is formed more than a predetermined length so as to be inserted into the insertion part 29 more deeply. Accordingly, even if an impulse is applied from the outside, the hooking part 35 is not easily detached from the insertion part 29. That is, the elevation part 33 is a portion for use in reliably performing a hooking operation of the hooking part 35. The contraction part 34, which is a portion by which the hooking operation is performed after being inserted into the supporting panel 25, is not detached unless more than a predetermined force is applied. The hooking part 35 can be smoothly inserted when the insertion terminal 36 is inserted and the hooking operation with the supporting panel 25 is performed, whereby detachment of the insertion terminal 36 can be prevented. Further, the contraction part 34 is transformed in such a way that its width gets narrow when the insertion terminal 36 is inserted and restored back to its original shape after the insertion is completed, so that the hooking operation with the supporting panel 25 is easily performed.

In the meantime, since the contraction part 34, the hooking part 35, and the insertion terminal 36 are portions for use in fixing the heater supporting bracket 20 to the supporting panel 25 by being inserted into the supporting panel 25, those members can be given a single name of an elastic fixing protuberance as a whole.

Referring to FIG. 5, the supporting panel 25 is a plate-shaped frame and includes: a supporting surface 27 which part of the heater supporting bracket 20 is inserted into and supported by; a reinforcement rib 28 bent in one direction from both edges of the supporting surface 27, for reinforcing a strength of the supporting surface 27; a fixing part 30 bent a predetermined slope angle from an end of the supporting surface 27.

More specifically, a rectangular recess 29 for receiving the insertion terminal 36 is formed in a predetermined position of the supporting surface 27. The elastic fixing protuberance consisting of the contraction part 34, the hooking part 35 and the insertion terminal 36 is inserted as a whole into the recess 29, so that a position of the heater supporting bracket 20 can be supported. As described above, since the contraction part 34, the hooking part 35 and the insertion terminal 36 are portions for being inserted into and fixed to the supporting panel 25, those members can be referred to as the elastic fixing protuberance. In short, the elastic fixing protuberance is inserted into the supporting panel 25, whereby the position of the heater supporting bracket 20 can be fixed with respect to the supporting panel 25.

Further, the reinforcement rib 28, which is a portion bent from both edges of the supporting surface 27, prevents the bending of the supporting surface 27 by increasing moment of inertia of the supporting surface 27. Such a configuration causes the position of the heater supporting bracket 20 not to change.

An operation of the mounting structure of the heating element according to the present invention will now be described. First, both the ends of the supporting panel 25 are firmly fixed at the cooktop frame 16 by the first fastening member 26. Simultaneously, the heater supporting bracket 20 is firmly fixed to a rear side of the radiant heating element 11 by the second fastening member 19. Of course, when the heart supporting bracket 20 is fixed to the radiant heating element 11, the supporting terminal 38 is touched to a predetermined position of the radiant heating element 11, whereby the radiant heating element 11 is resultantly supported at its two portions by the heater supporting bracket 20. That is, the radiant heating element 11 may be supported by the fixing part 32 and the supporting terminal 38 of the heater supporting bracket 20.

After fixed to the radiant heating element 11, the heater supporting bracket 20 is fixed to the supporting panel 25 by a predetermined hooking operation. In other words, the elastic fixing protuberance consisting of the members 34, 35, and 36 is inserted into and fixed to the recess 29. Further, when the elastic fixing protuberance is inserted into the recess 29, the supporting panel 25 has been already fixed to the cooktop frame 16. Next, if the hot plate 15 is placed on an upper surface of the radiant heating element 11, the whole configuration of the cooktop is completed.

As described above, since the mounting process of the radiant heating element 11 is completed by the operation that the elastic fixing protuberance at a lower end of the heater supporting bracket 20 is inserted into the supporting panel 25 with the heater supporting bracket 20 fixed to a rear side of the radiant heating element 11 by the second fastening member, convenience in processing is increased.

Further, after the mounting process of the radiant heating element 11 is completed, the heater supporting bracket 20 is elastically transformed so as to possibly absorb an impulse even if an unexpected impulse is applied from the outside. Thus, closeness between the radiant heating element 11 and the hot plate 15 can be maintained. In addition, it is possible to prevent the apparatus from being damaged due to impulse between parts.

Second Embodiment

Even though the radiant heating element 11 is installed as described above, an external strong impulse may be occasionally applied to an oven upon packing and moving processes. In that case, since a relatively large impulse may be applied to the heater supporting bracket 20, the bracket 20 is plastic-transformed beyond a limit of elasticity and disordered permanently. Further, since an impulse that is not shock-absorbed is directly applied to the radiant heating element 11, there is a possibility that the radiant heating element 11 is destroyed. Still further, there is a problem in that gray matter constituting the heat insulating material 13 crumbles and is broke into pieces. Particularly, if a strong impulse is applied, the elastic fixing protuberance may be detached from the supporting panel 25.

Therefore, another embodiment for solving the above-mentioned problems is further provided.

Figure 6:
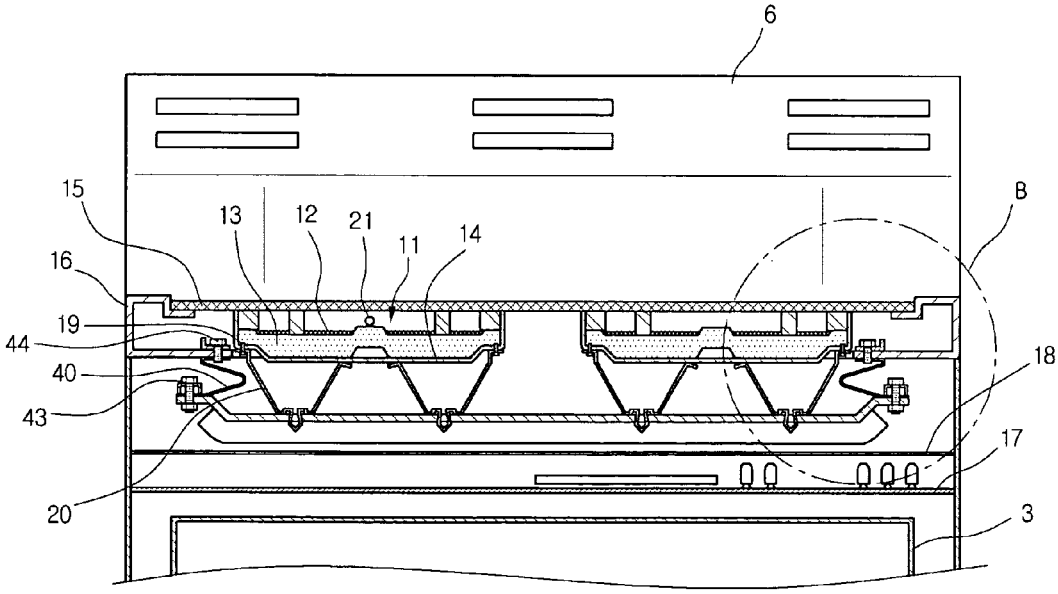
FIG. 6 is a cross-sectional view of a cooktop according to another embodiment of the present invention.
Figure 7:
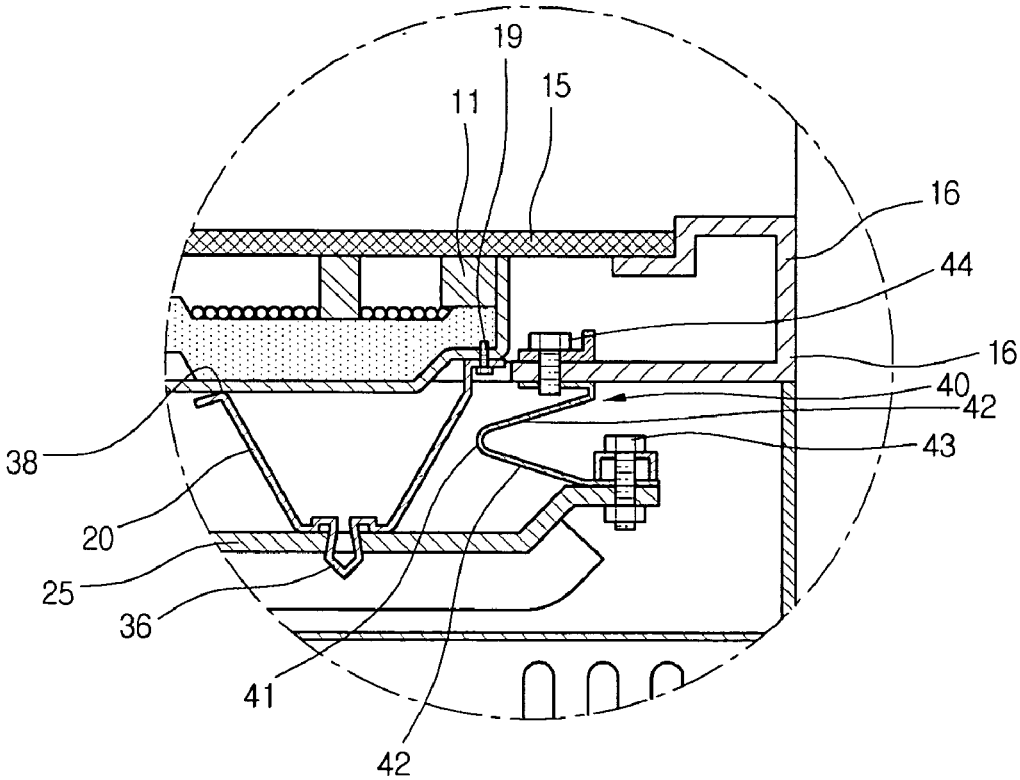
FIG. 7 is an enlarged view of a part "B" of FIG. 6.

FIG. 6 is a cross-sectional view of a cooktop according to another embodiment of the present invention and FIG. 7 is an enlarged view of a part "B" of FIG. 6. In a second embodiment of the present invention, the supporting panel 25 is not invariably fixed to the cooktop frame 16 but hung by a panel supporting bracket 40. Since the panel supporting bracket 40 is hung in a predetermined space, the supporting panel 25 can be moved in case a strong impulse such as moving of the product is generated. Therefore, such a configuration can reduce further more an impulse finally applied to the radiant heating element 11.

A further another embodiment of the present invention is described below in detail. Same reference numerals will be used to refer to the same parts as the first embodiment and newly added parts will be described in more detail.

Referring to FIGS. 6 and 7, according to a further another embodiment of the present invention, the supporting panel 25 is connected with the cooktop frame 16 with the panel supporting bracket 40 interposed, so that the supporting panel 25 may be supported in an elastically transformable manner. The panel supporting bracket 40 has a predetermined elastic transformation portion for performing a buffer function against an external impulse.

More specifically, the panel supporting bracket 40 is joined to the supporting panel 25 by a third fastening member 43 and joined to the cooktop frame 16 by the second fastening member 44. Further, a body of the panel supporting bracket 40 includes: elastic transformation parts 42 extended to at least different directions, respectively; an elastic supporting part 41 formed at a portion where the elastic transformation parts 42 are bent. Still further, the panel supporting bracket 40 can be formed in a ribbon shape similarly with the heater supporting bracket 20.

The elastic transformation part 42 alleviates an impulse by being bent against an external impulse. Further, the elastic supporting part 41, which is formed at a portion where the elastic transformation parts 42 are connected, attenuates the external impulse even more using transformation that a pair of elastic transformation parts 42 is unfolded or folded each other.

As described above, if an impulse is applied from the outside, the supporting panel 25 may be movable by the panel supporting bracket 40. Therefore, an external impulse is not directly applied to the heater supporting bracket 20 but can be attenuated by the panel supporting bracket 40. Accordingly, an impulse finally applied to the radiant heating element 11 can be reduced even more and disorder of the radiant heating element 11 can also be prevented owing to reduction of the impulse.

Further, in response to an external impulse, the heater supporting bracket 20 and the panel supporting bracket 40 are moved in the same direction, so that a probability that the elastic fixing protuberance, more specifically, the insertion terminal 36 is detached from the supporting panel 25 is reduced.

The heater supporting bracket 20, the radiant heating element 11, and other related elements have been described in the first embodiment, a detailed description thereof will be omitted.

Using the mounting structure of the heating element according to the present invention, the heating element can be operated in a reliable manner without disorder. That is, even if an external impulse is applied, a possibility of destruction is reduced.

Further, the mounting process of the heating element can be performed in a simple manner, whereby convenience in a manufacturing process is increased. Still further, since closeness between the heating element and the hot plate can be maintained even if the product is used for a long time, product life can be extended even more.

Another still further, since the radiant heating element can be supported by two-stage elastic supporting means, closeness between the radiant heating element and the hot plate can be precisely maintained.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A mounting structure of a radiant heating element, comprising:

a hot plate to which heat of the radiant heating element is transferred;

a cooktop frame by which the hot plate is supported;

a supporting panel formed at a lower portion spaced from the radiant heating element;

a heater supporting bracket between the radiant heating element and the supporting panel, for having the radiant heating element stick to the hot plate, the heater supporting bracket being interconnectable with the supporting panel by a protuberance which is receivable in a receiving aperture; and a panel supporting bracket between the supporting panel and the cooktop frame, for hanging the supporting panel.

2. The structure according to claim 1, wherein the panel supporting bracket is connected with both ends of the supporting panel.

3. The structure according to claim 1, wherein the both ends of the supporting panel are bent upward.

4. The structure according to claim 1, wherein the panel supporting bracket is bent in a ribbon shape.

5. The structure according to claim 1, wherein the heater supporting bracket forms an inverted triangle and whose one upper corner is fixed to the radiant heating element and whose lower corner is fixed to the supporting panel by a predetermined protuberance and whose other upper corner is touched to and supported by a rear surface of the radiant heating element.

6. The structure according to claim 1, wherein the panel supporting bracket comprises at least more than two elastic transformation parts bent and extended in different directions.

7. The structure according to claim 1, wherein the protuberance is on the heater supporting bracket and the receiving aperture is in the supporting panel.

8. A mounting structure of a radiant heating element comprising:

a hot plate to which heat of the radiant heating element is transferred;

a cooktop frame by which an outer periphery of the hot plate is supported;

a supporting panel formed at a lower portion spaced from the radiant heating element; and a heater supporting bracket having a fixing part, an elastic fixing part, and an elastic movable supporting part, the fixing part being in contact with the radiant heating element and being fixed to the radiant heating element by a predetermined fastening member, the elastic movable supporting part being in contact with the radiant heating element and being moveable with respect to the radiant heating element, the elastic fixing part being interconnectable with the supporting panel by a protuberance which is receivable in a receiving aperture.

9. The structure according to claim 8, wherein the heater supporting bracket is of a ribbon shape so as to apply predetermined elastic restoring force.

10. The structure according to claim 8, wherein the supporting panel is fixed to the cooktop frame.

11. The structure according to claim 8, wherein the supporting panel is hung on the cooktop frame.

12. The structure according to claim 8, wherein the supporting panel comprises a rectangular-shaped recess for receiving the elastic fixing protuberance.

13. The structure according to claim 8, wherein the protuberance is on the elastic fixing part and the receiving aperture is in the supporting panel.

14. The structure according to claim 13, wherein the protuberance of the elastic fixing part comprises: an insertion terminal; a hooking part expanded and extended from the insertion terminal; and a contraction part contracted from the hooking part.

15. The structure according to claim 13, wherein the protuberance of the elastic fixing part comprises an insertion terminal whose end forms a cusp pointed at its end.

16. A mounting structure of a radiant heating element comprising:

a radiant heating element;

a hot plate to which heat of the radiant heating element is transferred;

a cooktop frame by which an outer periphery of the hot plate is supported;

a supporting panel formed at a lower portion spaced from the radiant heating element; and a heater supporting bracket having a fixing part aligned with the radiant heating element and formed at its one end, for being fixed by a predetermined fastening member, and an elastic fixing protuberance elastically transformed at and inserted into a predetermined position of the supporting panel, wherein the elastic fixing protuberance comprises: an insertion terminal; a hooking part expanded and extended from the insertion terminal; and a contraction part contracted from the hooking part.

17. A mounting structure of a radiant heating element comprising:

a hot plate to which heat of the radiant heating element is transferred;

a supporting panel formed at a lower portion spaced from the radiant heating element; and a heater supporting bracket forming an inverted triangle, a first upper corner of the heater supporting bracket being in contact with and being fixed to the radiant heating element, a second upper corner of the heater supporting bracket being in contact with the radiant heating member and being moveable with respect to the radiant heating member, a lower corner of the heater supporting bracket being interconnectable with the supporting panel by a protuberance which is receivable in a receiving aperture.

18. The structure according to claim 17, wherein the second upper corner of the heater supporting bracket is bent.

19. The structure according to claim 17, further comprising:

a cooktop frame by which the hot plate is supported and to which the supporting panel is fixed.

20. The structure according to claim 17, further comprising:

a cooktop frame by which the hot plate is supported; and a panel supporting bracket interposed between the cooktop frame and the supporting panel, for having the supporting panel hung.

21. The structure according to claim 17, further comprising:

a panel supporting bracket interposed between the supporting panel and a cooktop frame so as to elastically support the supporting panel.

22. The structure according to claim 17, wherein the protuberance is on the lower corner of the heater supporting bracket and the receiving aperture is in the supporting panel.

23. A mounting structure of a heating element comprising:

a hot plate to which heat of a radiant heating element is transferred;

a cooktop frame by which an outer periphery of the hot plate is supported;

a supporting panel formed, as a separate member, at a bottom surface of the radiant heating element; and a heater supporting bracket having a radiant heating member side sand a supporting panel side, the radiant heating member side being in contact with and being fixed to the radiant heating member by a predetermined fastening member and the supporting panel side being interconnectable with the supporting panel by a protuberance receivable in a protuberance receiving aperture so as to be variably supported.

24. The structure according to claim 23, further comprising:

a panel supporting bracket interposed between the supporting panel and the cooktop frame, for having the supporting panel hung on the cooktop frame.

25. The structure according to claim 23, wherein the protuberance is on the supporting panel side of the heater supporting bracket and the receiving aperture is in the supporting panel.

26. A mounting structure of a heating element comprising:

a radiant heating element;

a hot plate to which heat of the radiant heating element is transferred;

a supporting panel formed at a lower portion spaced from the radiant heating element; and a heater supporting bracket which forms an inverted triangle and whose one upper corner is fixed to the radiant heating element and whose lower corner is inserted into and fixed to the supporting panel by a predetermined protuberance and whose other upper corner supports a rear surface of the radiant heating member; and a panel supporting bracket interposed between the supporting panel and a cooktop frame so as to elastically support the supporting panel.

* * * * *